US005746619A

United States Patent [19]

Harting et al.

[11] Patent Number: 5,746,619

[45] Date of Patent: May 5, 1998

[54] COAXIAL PLUG-AND-SOCKET CONNECTOR

[75] Inventors: Dietmar Harting, Espelkamp; Dirk Oberhokamp, Herford; Ralf Bokamper, Lubbecke; Horst Blomenkamp, Hullhorst; Stephan Schreier, Espelkamp, all of Germany

[73] Assignee: Harting KGAA, Espelkamp, Germany

[21] Appl. No.: 727,246

[22] Filed: Oct. 8, 1996

[30] Foreign Application Priority Data

Nov. 2, 1995 [DE] Germany ..... 295 17 358.0

[51] Int. Cl.[6] ..... H01R 13/627

[52] U.S. Cl. ..... 439/352; 439/353; 439/578

[58] Field of Search ..... 439/350, 352, 439/353–354, 357, 358, 578

[56] References Cited

U.S. PATENT DOCUMENTS 5,082,455 1/1992 Wei ..... 439/352

5,176,533 1/1993 Sakurai et al. ..... 439/352

FOREIGN PATENT DOCUMENTS 9204911.5 of 1992 Germany .

*Primary Examiner*—Khiem Nguyen

*Attorney, Agent, or Firm*—Dorn, McEachran, Jambor & Keating

[57] ABSTRACT

A coaxial plug-and-socket connection comprising a socket part and a pin part with releasable interlocking of the two parts, wherein during the insertion process a spring element on one of the two connection parts, which is independent of the interlocking element, exerts an axial resistance and repels the other connection part so long as the interlocking device is not effectively latched, it is proposed to provide the parts of the plug-and-socket connection with sleeves which are insertable one into the other, outwardly directed spring detent hooks being provided on the sleeve of the pin part, and to provide an interlock deactivating sleeve which acts upon the detent hooks and enables an intentional deactivation of the interlock of the plug-and-socket connection.

4 Claims, 2 Drawing Sheets

COAXIAL PLUG-AND-SOCKET CONNECTOR

Figure 3:
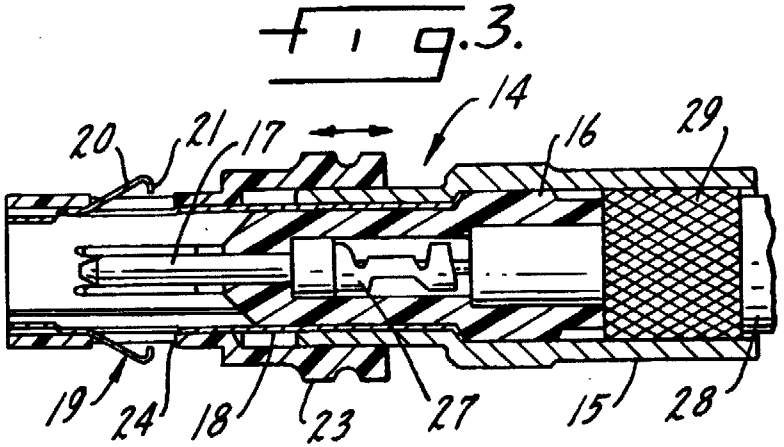

The invention relates to a coaxial plug-and-socket connection comprising a socket part and a pin part with releasable interlocking using spring or spring-mounted detent elements on the one connection part and complementary arresting means on the other connection part, wherein the detent elements are releasable out of or from the arresting means by a force directed preferably orthogonally relative to the axis of the plug-and-socket connection and incapable of being generated by pulling on the two cables and wherein during the insertion process a spring element on one of the two connection parts, which is independent of the interlocking element, exerts an axial resistance and repels the other connection part so long as the interlocking device is not effectively latched.

Such plug-and-socket connections are used for the reliable connection of coaxial cables in the field of high-frequency engineering where it is essential to guarantee that the connection is always properly intermated.

From DE-GM 92 04 991 a coaxial plug-and-socket connection is known, in which a pressure spring is provided which presses the two coaxial connectors apart when they are not properly intermated so that an improper connection of the two coaxial connectors is immediately detectable. The known plug-and-socket connection is moreover provided with an interlocking device, which holds the coaxial connectors together after they have been intermated. The pressure spring of said plug-and-socket connection is disposed over the outer shielding sleeve of the plug-in coaxial connector and takes up a relatively large amount of room.

The object of the invention is to design a coaxial plug-and-socket connection of the type described initially in such a way that it may be miniaturized while retaining the impedance of the known plug-and-socket connections.

Said object is achieved in that the outer sleeve of the pin part comprises a front, thin-walled sleeve which is insertable into the socket part, that an interlock deactivating sleeve is provided which is longitudinally displaceable on the sleeves, that spring detent hooks bent out from the thin-walled sleeve are directed outwards through openings of the interlock deactivating sleeve, the detent hooks having a front slope and a rear interlocking end and the interlocking sleeve being pressed forward by the slope, that the socket part comprises an outer sleeve, into which a helical pressure spring is inserted, that there is inserted into the outer sleeve a thrust sleeve provided with shoulders, the front end of which engages into the pressure spring and the rear end of which is held slidably in the outer sleeve, and that a terminating sleeve is inserted into the outer sleeve, the inner edge of the terminating sleeve forming on the one hand a stop for the thrust sleeve and on the other hand a detent shoulder for the detent hooks.

Advantageous refinements of the invention are indicated in claims 2 to 4.

The advantages achieved by the invention are in particular that as a result of the thin-walled sleeve at the front end of the pin part, which upon intermating of the plug-and-socket connection is inserted into the outer sleeve of the socket part, and as a result of the detent hooks and spring tongues bent out from the thin-walled sleeve, which are used on the one hand for latching and on the other hand for the electrical contacting of the sleeve with the outer sleeve of the socket part, the external dimensions of the complete plug-and-socket connection may be kept extremely small.

Figure 4:
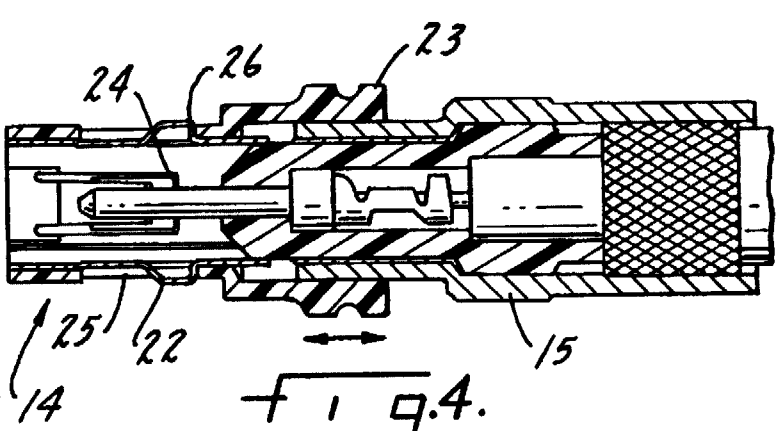
Figure 1:
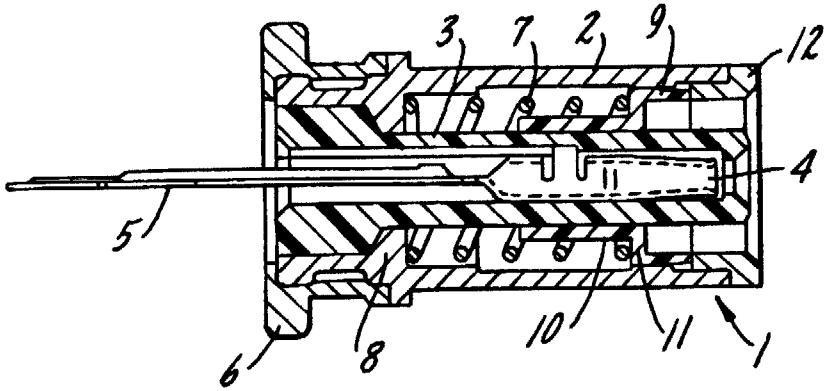
Figure 2:
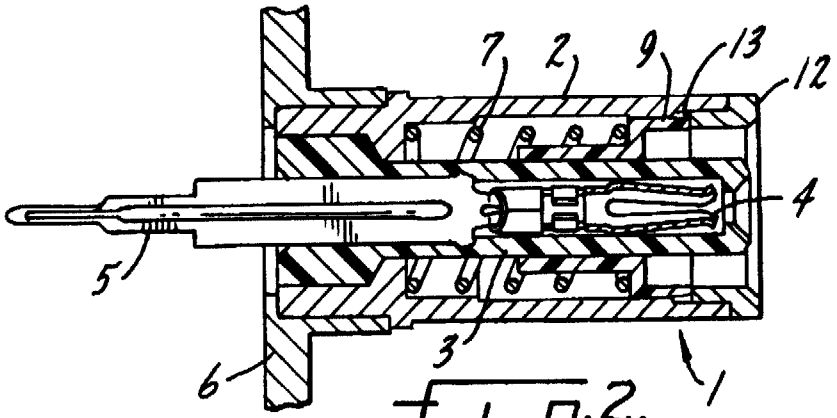
Figure 5:
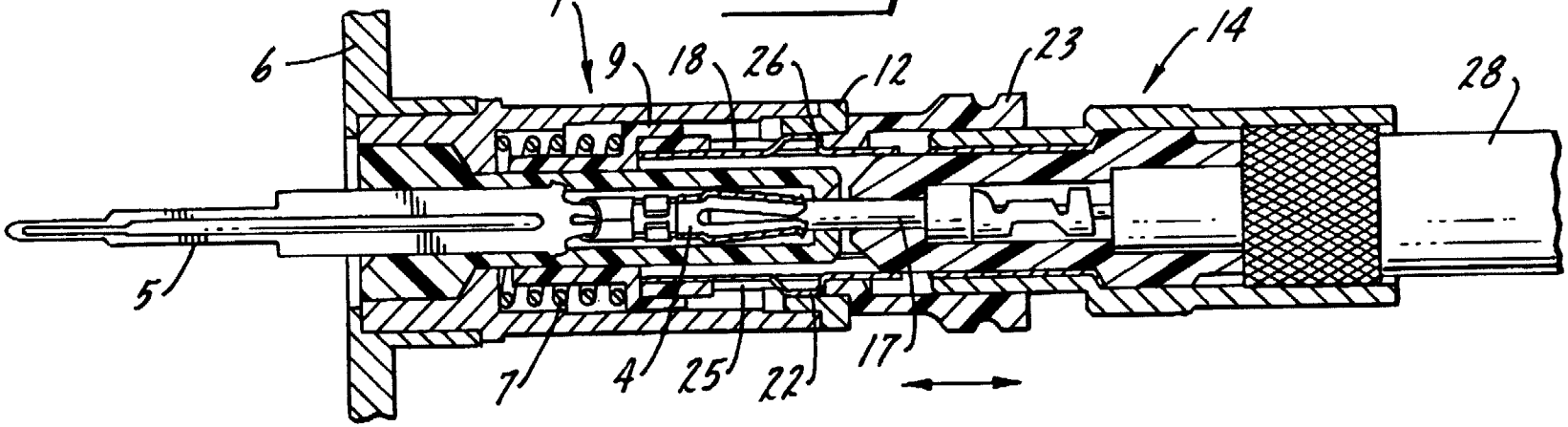
Figure 6:
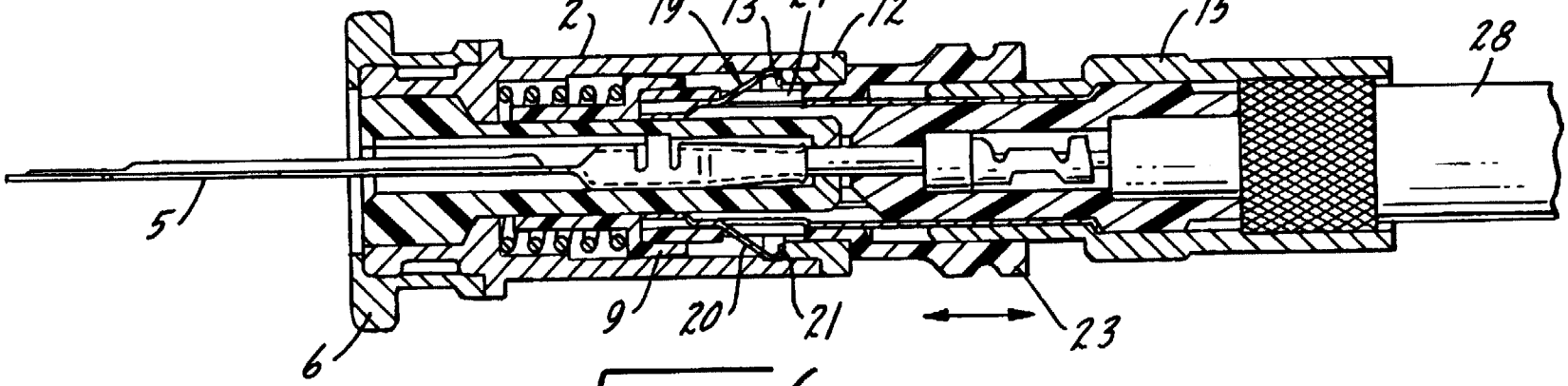

An embodiment of the invention is illustrated in the drawings and described in detail below. The drawings show:

FIG. 1 a view of a socket part in section,

FIG. 2 the view of the socket part according to FIG. 1 in section rotated through 90°, FIG. 3 a view of a pin part in section, FIG. 4 the view of the pin part according to FIG. 3 in section rotated through 90°, FIG. 5 a view of an intermated plug-and-socket connection in section, and FIG. 6 the view of the plug-and-socket connection according to FIG. 5 in section rotated through 90°.

The socket part 1 for a coaxial plug-and-socket connection shown in FIGS. 1 and 2 substantially comprises a round outer sleeve 2, in which a socket-contact 4 held in an insulating part 3 is centrically disposed. The socket-contact is provided with a connection end 5 which here, for example, takes the form of a connection to a printed circuit of a printed-circuit board. The outer sleeve 2 here is moreover pressed into a fastening flange 6. It may however alternatively be provided that the socket part is designed for the connection of a coaxial cable.

Disposed inside the outer sleeve is a helical pressure spring 7, which rests against an inner shoulder 8 of the outer sleeve. A thrust sleeve 9 is moreover inserted into the outer sleeve.

The thrust sleeve has a front, stepped end 10, which is inserted into the helical pressure spring until the pressure spring rests against the shoulder 11 thus formed. The inside diameter of the thrust sleeve is so dimensioned that the thrust sleeve slides in a centrically guided manner on the insulating part 3, and the outside diameter of the non-stepped part is dimensioned so as to enable an easy sliding movement in the outer sleeve 2. The inside diameter of the thrust sleeve is enlarged in the non-stepped region in order to allow engagement of the front sleeve of the mating connector (the pin part) which is described further below.

Finally, the socket part additionally has a front terminating sleeve 12, which is pressed into the outer sleeve 2. The front edge 13 of said terminating sleeve then prevents the thrust sleeve from sliding out of the socket part.

For the sake of completeness it should additionally be mentioned that the outer sleeve 2 and the terminating sleeve 12 are made of electrically conductive metal material.

The pin part 14 for the coaxial plug-and-socket connection shown in FIGS. 3 and 4 substantially comprises a round outer sleeve 15, in which a contact pin 17 held in an insulating part 16 is centrically disposed. Inserted into the outer sleeve is a thin-walled, front sleeve 18 which projects beyond the contact pin in a forward direction. At opposite sides of the sleeve, two spring-elastic detent hooks 19 are cut and bent out from the sleeve material. Said detent hooks comprise a slope 20 and a rear end 21, which extends at right angles to the axis of the pin part.

At, likewise, opposite sides of the sleeve, two spring-elastic contact tongues 22 are moreover cut and bent out from the sleeve material. The detent hooks 19 and the contact tongues are then each offset by 90° relative to one another. The contact tongues are shaped in such a way that, in the intermated plug-and-socket connection (FIG. 5), they press resiliently against the inner surface of the terminating sleeve and establish a proper electrical contact between the sleeve 18 of the pin part and the sleeve 12, 2 of the socket part.

Disposed over the outer sleeve 15 and the front sleeve 18 is an axially displaceable interlock deactivating sleeve 23. Said interlock deactivating sleeve is provided with slot-like openings 24, 25 in the region of the detent hooks and contact tongues, which project through said openings. In so doing, the slope 20 of the detent hooks presses upon the edge of the respective through-opening in such a way that the sleeve 18 is pressed forward into the "interlocking position" while, upon attainment of the front "end position", a shoulder 26 of the contact tongues comes to rest against the edge of the openings 25, through which the contact tongues project outwards, and prevents further displacement of the interlock deactivating sleeve.

The contact pin 17 is provided at its connection end 27 with a crimp snap-on connector, to which the neutral conductor of a coaxial cable 28 is connected. The coaxial cable is inserted into the outer sleeve 15 of the pin part, and the cable shield 29 is connected in an electrically conductive manner to the outer sleeve.

FIGS. 5 and 6 show an intermated plug-and-socket connection. When the pin part 14 is plugged into the socket part 1, the front, thin-walled sleeve 18 is inserted into the socket part and then presses upon the thrust sleeve 9 so that the pressure spring is compressed. At the same time, the contact pin 17 moves into the socket-contact 4 and into electric contact with said socket-contact.

During insertion, the slopes 20 of the detent hooks 19 first reach the outer edge of the terminating sleeve 12 and are then bent initially inwards. As soon as the pin part has been inserted far enough into the socket part, i.e. once the detent hooks have been pushed through the terminating sleeve, the detent hooks 19 spring outwards and their ends 21 move behind the front (inner) edge 13 of the terminating sleeve. As a result, the pin part and the socket part are then interlocked. In the intermated plug-and-socket connection, the contact tongues 22 press against the insides of the terminating sleeve 12 and improve the electrical contacting of the outer sleeves 2, 15 of the plug-and-socket connection.

The pressure spring ensures that the two parts of the plug-and-socket connection are always pressed apart again if the interlocking device has not properly latched.

The interlock deactivating sleeve 23, which is preferably made of plastic material, is provided for disengaging the plug-and-socket connection. Said interlock deactivating sleeve is disposed on the pin part 14 and, for cancelling the interlock, is displaced in the opposite direction to the insertion direction on the pin part. During said process, the edges of the openings 24 then press against the slope 20 of the detent hooks 19, and the detent hooks are bent inwards in such a way that their ends 21 move out of engagement with the edge of the terminating sleeve and the pressure spring presses the pin part out of the socket part.

We claim:

1. Coaxial plug-and-socket connection comprising a socket part and a pin part with releasable interlocking using spring or spring-mounted detent elements on the one connection part and complementary arresting means on the other connection part, wherein the detent elements are releasable out of or from the arresting means by a force directed preferably orthogonally relative to the axis of the plug-and-socket connection and incapable of being generated by pulling on the cables of socket part and pin part and wherein during the insertion process a spring element on one of the two connection parts, which is independent of said detent elements, exerts an axial resistance and repels the other connection part so long as the interlocking is not effectively latched, characterized in that the outer sleeve (15) of the pin part (14) comprises a front, thin-walled sleeve (18) which is insertable into the socket part (1), that an interlock deactivating sleeve (23) is provided which is longitudinally displaceable on the sleeves (15, 18), that spring detent hooks (19) bent out from the thin-walled sleeve (18) are directed out through openings (24) of the interlock deactivating sleeve (23), the detent hooks having a front slope (20) and a rear interlock deactivating end (21) and the interlocking sleeve being pressed forward by the slope, that the socket part (1) comprises an outer sleeve (2), into which a helical pressure spring (7) is inserted, that there is inserted into the outer sleeve (2) a thrust sleeve (9) provided with shoulders, the front end (10) of which engages into the pressure spring and the rear end of which is held slidably in the outer sleeve (2), and that a terminating sleeve (12) is inserted into the outer sleeve (2), the inner edge (13) of the terminating sleeve forming on the one hand a stop for the thrust sleeve (9) and on the other hand a detent shoulder for the detent hooks (19).

2. Coaxial plug-and-socket connection according to claim 1, characterized in that spring-elastic contact tongues (22) bent out from the thin-walled sleeve (18) project out through associated openings (25) of the interlock deactivating sleeve (23), which contact tongues in the intermated plug-and-socket connection press against the inside (12) of the terminating sleeve and of the outer sleeve of the socket part.

3. Coaxial plug-and-socket connection according to claim 2, characterized in that the contact tongues (22) each case comprise rear stop shoulders (26) which, in cooperation with the edges of the openings (25), delimit the forward motion of the interlock deactivating sleeve (23) occasioned by the slopes (20) of the detent hooks (19).

4. Coaxial plug-and-socket connection according to claim 1, characterized in that the thin-walled sleeve (18) comprises two half-shells.

* * * * *